US005899369A

United States Patent [19]

Macripo

[11] Patent Number: 5,899,369

[45] Date of Patent: May 4, 1999

[54] BRACELET CLOSURE AID

[76] Inventor: Peter D. Macripo, 527 Walker Ave., Penndel, Pa. 19047

[21] Appl. No.: 08/871,722

[22] Filed: Jun. 9, 1997

[51] Int. Cl.[6] ..... A47G 25/80

[52] U.S. Cl. ..... 223/111

[58] Field of Search ..... 223/111, 1; D11/3; 63/3

[56] References Cited

U.S. PATENT DOCUMENTS

| | | | |
|---|---|---|---|
| D. 323,132 | 1/1992 | Grennan | 223/111 |
| 2,473,226 | 6/1949 | Sheldon | 63/3 |
| 2,524,976 | 10/1950 | Holl | 63/3 |
| 3,547,323 | 12/1970 | Sledge | 63/3 |
| 4,072,255 | 2/1978 | Bogorad | 223/111 |
| 4,130,226 | 12/1978 | Farrell | 223/111 |
| 5,405,066 | 4/1995 | Fakier | 223/111 |

*Primary Examiner*—Bibhu Mohanty
*Attorney, Agent, or Firm*—Daniel Kramer

[57] ABSTRACT

A device for attaching or placing on the wrist for the purpose of securely holding one end, the receiving end, of a bracelet while the other bracelet end having a catch or clasp, is fastened to the held end. The device thereby allows the wearer to correctly and securely install the bracelet on his/her own wrist without anyone's aid. The device includes an elastic wrist band and means secured to the band for holding the bracelet end. The bracelet end holding means includes a folded portion having opposing hook and loop matrixes within which the bracelet receiving end is placed before the hook and loop matrixes are pressed together, thereby securing the bracelet receiving end to the folder and to the wrist band.

8 Claims, 2 Drawing Sheets

BRACELET CLOSURE AID

BACKGROUND

1. Field of the Invention

This invention relates to the field of devices which removeably fasten around the wrist of a human being for the purpose of temporarily holding an object.

Wearers of non-expandable bracelets, both decorative and those employed to secure watches or medical devices to the wrist, frequently face difficulty in fastening the bracelet ends together on their wrist. The problem arises most frequently when the bracelet is to be worn on the wrist of the dominant hand. In that situation the less coordinated non-dominant hand is called on to fasten a small and frequently recalcitrant catch or clasp. Further, small bracelets are very flexible and the target or receiving end of the bracelet to which the catch or clasp is to be engaged, moves so easily that the wearer frequently requires help from another person to successfully install the bracelet on his wrist.

With the help of this invention a person need only secure the bracelet receiving end within the hook-loop folder, slip the band on his wrist and then fasten the catch or clasp to the target or receiving end of the bracelet, now held securely in the hook-loop folder. Once fastened, the folder is opened, releasing the bracelet, and the band slipped off the wrist and placed in pocket or purse ready for its next use.

2. Discussion of Prior Art

Elastic wrist bands are well known. Hook and loop fasteners such as offered under the tradename "Velcro" are widely used as shoe fasteners in place of laces, as fasteners for sweat bands and sporty watch bands and as adjustment means for headwear such as caps.

However, no application or construction is known where a wrist band is employed as a base for holding a bracelet end while the other bracelet end is attached.

OBJECTS AND ADVANTAGES

It is therefore an object of the present invention to provide wrist mounted means for temporarily securing and holding one end of a bracelet or other wrist surrounding device while the other end is attached to the held end.

It is a further object to provide such a device which can be easily secured to the wrist and easily removed after the bracelet ends have been joined.

It is a further object to provide such a device which includes wrist mounting means and bracelet end holding means secured to the wrist mounting means, It is a further object to provide such a device where the wrist mounting means is an elastic band.

It is further object to provide such an object where the wrist mounting means is a band having a fastener.

It is a further object to provide such a device where the fastener is of the hook and loop type.

It is a further object to provide such a device where the bracelet end holding means includes a folder having a hook and loop closure.

It is a further object to provide such a device having means attached to the wrist mounting means for preventing movement of said wrist mounting means during the bracelet fastening procedure.

It is a further object to provide such a device where the movement preventing means is mounted to the outside of the band for engagement with the knee or other body part.

It is a further object to provide such a device where the movement preventing means is a friction pad mounted to the inside of the band, It is a further object to provide a device which can be employed with am existing band such a watch strap.

Therefore the present invention provides simple and low cost means for allowing a user to attach the ends of a bracelet or other piece of jewelry employing a device which is light and compact and can easily be carried in purse or pocket. Further objects and advantages of my invention will become apparent from a consideration of the drawings and the ensuing description.

BRIEF DESCRIPTION OF THE DRAWINGS

Referring now to the figures: There is displayed in FIG. 1 an elastic band having a hook and loop folder attached thereto for gripping a bracelet receiving end.

REFERENCE LIST OF DRAWING NUMERALS

Figure 1:
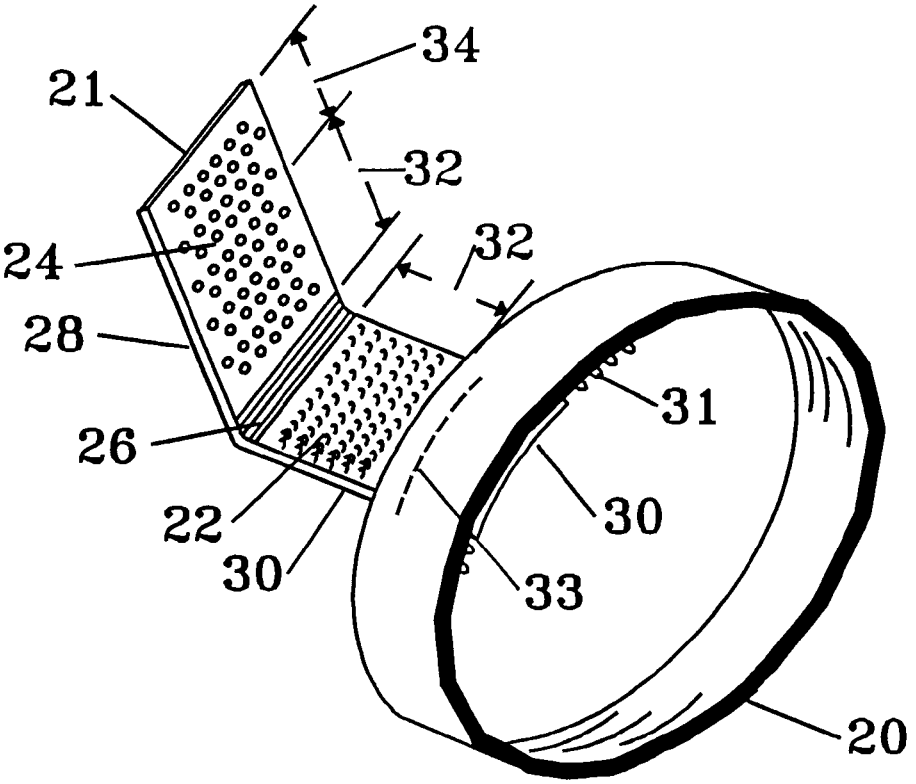

| | |
|---|---|
| 20 | Elastic Band |
| 21 | hook/loop folder |
| 22 | hook matrix |
| 24 | loop matrix |
| 26 | cloth hinge |
| 28 | backer for loop matrix |
| 29 | hook and loop meshed or engaged areas |
| 30 | backer for hook matrix |
| 31 | loops on inside of band 20 |
| 32 | engagement distance for hooks and loops |
| 33 | stitching for securing hook/loop folder to band 20 |
| 34 | unengaged overlap distance for easy release (overlaps elastic band) |
| 35 | easy release tab |
| 36 | bracelet |
| 38 | bracelet receiving end to be held |
| 40 | mating bracelet end with clasp |
| 42 | clasp lever for opening latch 46 to allow hook 44 to engage bracelet receiving end 38 |
| 44 | hook for engaging bracelet receiving end |
| 46 | latch actuated by lever 42 to allow hook to engage/disengage bracelet end 38 |
| 48 | non-elastic band |
| 50 | hooked band end |
| 54 | un-hooked band end |
| 56 | hook array or matrix on band end interior |
| 58 | loop array or matrix on band end exterior |
| 60 | elastic band with enlarged pad |
| 62 | enlarged wrist pad |
| 64 | hinged backer for loop matrix |
| 66 | loop matrix |
| 68 | backer for hook matrix |
| 70 | hook matrix on backer 68 |
| 72 | latex friction pads |
| 74 | fabric hinge |
| 76 | external anti-slip friction pad |
| 78 | internal anti-slip pad |

-continued

| | |
|---|---|
| 80 | watch strap |
| 82 | bracelet end of folder |
| 84 | distal end of folder |

DETAILED DESCRIPTION OF THE INVENTION

Referring now to the drawings, wherein like references are used to indicate like elements, there is shown in FIG. 1 an elastic band 20 whose dimensions are selected to allow it to be easily slipped over the hand and to reside on the wrist of a user desiring to install a bracelet on his wrist. Typically the band has a width of between one half and three quarters of an inch (13 to 21 mm) and a diameter of three inches (76 mm), though the initial at-rest diameter may vary, a smaller diameter being provided for women's use and a larger diameter for men. In the case of the band being fabricated of a highly elastic material the smaller size may be readily stretched to fit larger wrists.

Attached to the interior of the band is one page 30 of a hook/loop folder 21. The interior side of the folder page 30 is substantially covered with a matrix of hooks 22 which form one part of a hook and loop pair.

The folder page 30 is attached to the interior of band 20 by stitches 33. In another embodiment, loops 31 are positioned on the interior of band 20 and the hooks 22 of folder page 21 engage the interior loops 31 thereby providing attachment of the page 30 to band 20, without the need of stitches.

Folder page 30, the hook page, described above, is joined at its distal edge, by a fabric hinge 26, to a second folder page 28, the loop page. The interior surface of folder page 28 is substantially covered with a matrix of loops 24, thereby forming the second part of the hook and loop folder pair.

Figure 2:
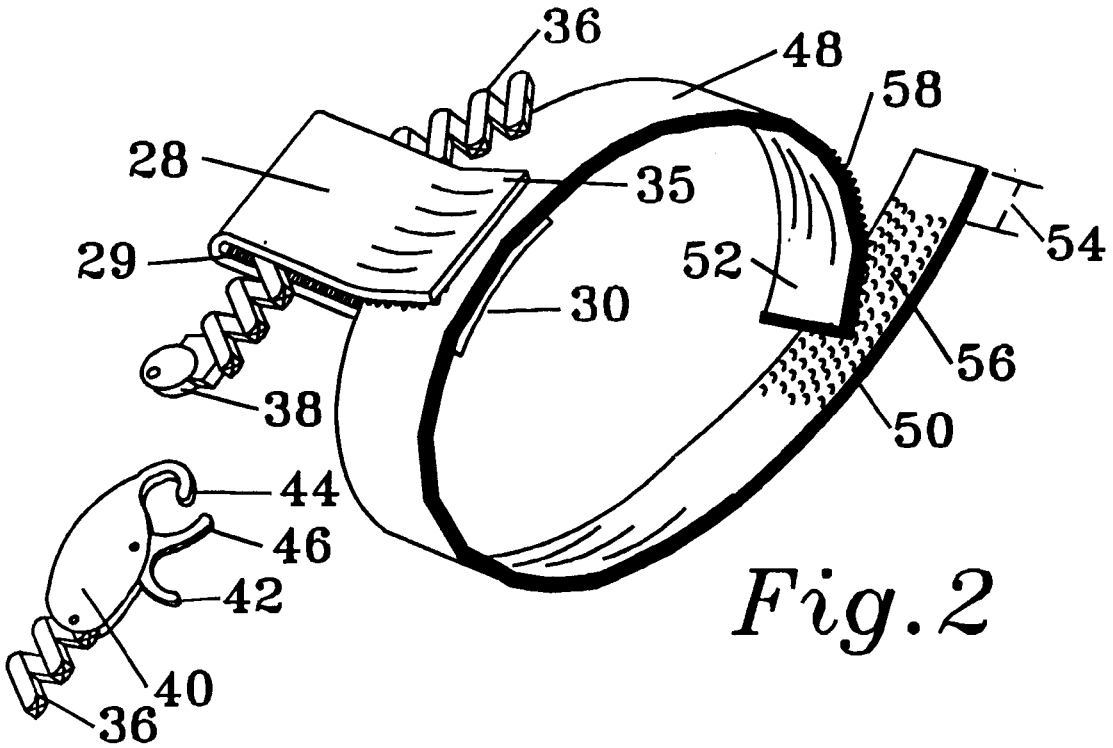
FIG. 2 shows a non-elastic band having a hook and loop closure. The hook and loop folder is shown closed over a typical bracelet receiving end with the mating bracelet catch or clasp end juxtaposed.

In order to secure the end 38 of a bracelet 36, the bracelet is inserted within the folder 21 in such position that it contacts a portion of the hook matrix 22. Then the loop page 28 of the folder 21 is closed over the bracelet 36 to secure the bracelet end 38, by folding at hinge 26 so that hook surface 22 engages loop surface 24, as displayed in FIG. 2. When the bracelet 36 is secured, as shown in FIG. 2, the portion 35 of the loop page 28, which overlays the surface of band 20, also defined by distance 34 (FIG. 1), is unengaged with a corresponding hook matrix. This unengaged matrix portion 35 of the loop page 28 provides an unsecured tab which can be readily grasped and employed to pull open the previously engaged folder pages.

The distances 32 in FIG. 1 illustrate the relative area of the hook and of the loop portions which are available for grasping the bracelet and for securing the two pages of folder 21 together. In a preferred arrangement the dimension 34 is ⅜ inch (9.5 mm) and the dimensions 32 are 1 inch (25 mm) and the length of hinge 26 is 1 inch (25 mm)

In FIG. 2 the clasp end 40 of the bracelet 36 is shown with a hook type clasp which is only one of many forms of clasp employed to join bracelet ends. It should be noted that the type of clasp shown is for illustration only since the invention described works well with any type of clasp.

In FIG. 2 clasp lever 42 is moved in the direction of the bracelet links 36 causing clasp member 46 to open a gap with hook 44. The hook 44 is then moved to engage the secured or receiving end 38 of the bracelet and the lever 42 is released, thereby allowing member 46 to move toward and engage the end of hook 44, completing the installation process.

The wearer then pulls unmeshed tab 35 to open the folder and disengage bracelet 36 and simply slips the band 20 from his wrist.

In FIG. 2 an alternate configuration of band 20 is shown in the form of band 48. Band 48 is formed of a substantially non-elastic material such as canvas or leather. A hook and loop structure is applied to the ends of band 48 to permit convenient yet secure closure. In a preferred version the inside of the end 50 of band 48 is covered with a matrix of hook elements 56 and the outside of end 52 of band 48 is covered with an array or matrix of loop elements 58. With this non-elastic structure a firm and tight fit of band 48 can be secured on any size wrist.

Figure 3:
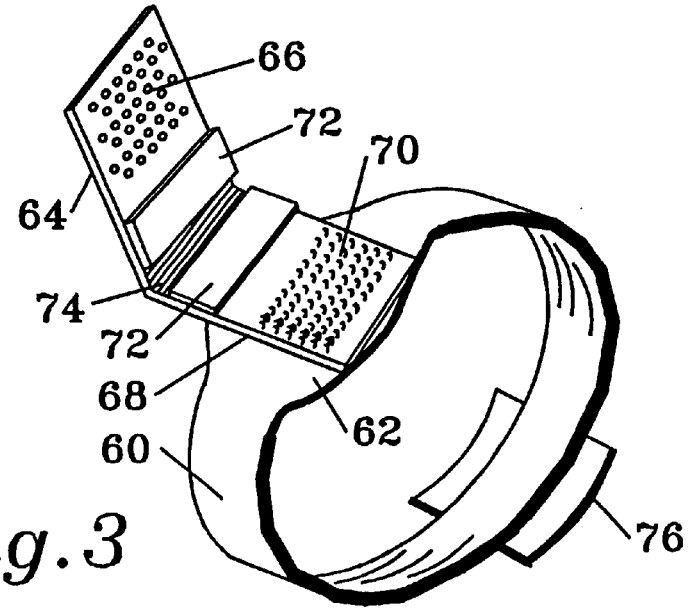
FIG. 3 is a oblique view of a elastic band having an enlarged portion for supporting the hook and loop folder and with a friction pad mounted to the exterior of the band diametrically opposite the folder.

In FIG. 3 there is displayed an elastic band 60 having an enlarged area for attaching the hook and loop folder 64. The enlarged area 62 of elastic band 60 provides a firm base for the folder 64. In order to provide a more secure grasp by the folder of a bracelet latex pads 72 are provided. One pad 72 is secured to the inner surface of each page of the folder 64.

Figure 4:
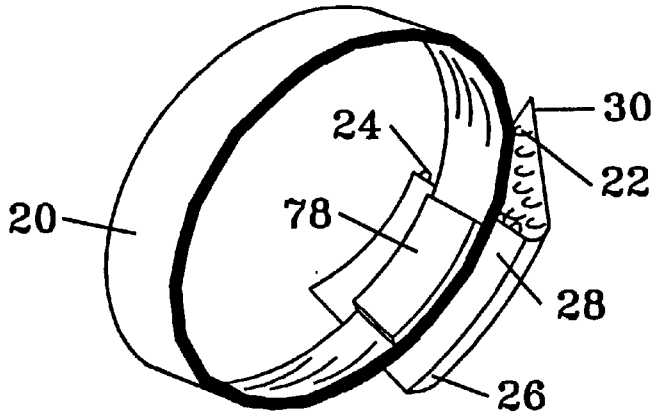
FIG. 4 is an oblique view of an elastic band and folder with a friction pad positioned internal of the band and adjacent the folder.

Under conditions where a large, heavy bracelet having a strong clasp is to be used, bands 20, 48 or 60 may have a tendency to rotate on the wrist. The restrict this tendency, external friction pad 76 is provided in FIG. 3. In use the user moves her wrist bearing the band so that external friction pad 70 bears against her clothing or knee, thereby preventing the band from rotating or moving under pressure imposed by her efforts to engage the bracelet catch with the bracelet held end. In an alternate construction shown in FIG. 4, internal latex pad 78 is provided positioned on band 20 directly adjacent to folder page 28 but on the inner surface of band 20. The latex pad 78 provides added friction with the user's wrist, thereby aiding in preventing unwanted movement of the folder or its supporting band.

Figure 5:
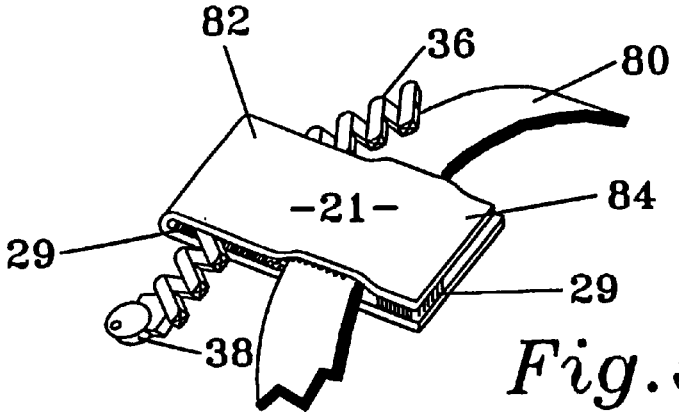
FIG. 5 shows a folder alone in place, holding a bracelet receiving end, where the band is an existing watch strap.

FIG. 5 displays a version of the invention applicable to wrists that already have a secure band such as a watch strap. In this version of the invention, folder 21 is formed with a length sufficiently long to span the width of watch strap 80. The extra folder length provides enough hook and loop matrix area to provide a secure closure on the near or bracelet side 82 of the watch strap 80 while leaving sufficient matrix area to provide secure closing on the far or distal side 84 of the watch strap.

From the foregoing description, it can be seen that the present invention comprises a unique structure for achieving the objective of facilitating the fastening of a bracelet. It will be appreciated by those skilled in the art that changes could be made to the embodiments described in the foregoing description without departing from the broad inventive concept thereof. It is understood, therefore, that this invention is not limited to the particular embodiment or embodiments disclosed, but is intended to cover all modifications which are within the scope and spirit of the invention as defined by the appended claims and their equivalents.

I claim:

1. A device for holding a bracelet end on a wearer's wrist, the bracelet having a clasp end and a receiving end, said device comprising band means for securely encircling the wearer's wrist, said band means having an exterior and an interior; a hook and loop folder secured to the band means at a point, said folder having hinge connected pages comprising a first page having a first length and a face bearing a matrix of hook-like elements, and a second page having a second length and a face bearing a matrix of loop-like elements designed and constructed to engage the hook-like matrix, whereby the matrix face of the first page may be hinge rotated into substantial contact with the matrix face of the second page, thereby surrounding with engaged hook-loop matrices and securing to the folder and to the wearer's wrist, a bracelet end placed between the page faces prior to rotation, and further providing a hook-loop interface between the exterior of one page of the folder and the band means at the point, whereby the folder may be attached and held securely to the band means at the point in any orientation with respect to the band means, by said hook-loop interface.

2. Bracelet holding means as recited in claim 1 further providing a slip resistant layer secured to the band means.

3. Bracelet holding means as recited in claim 2 further providing that the slip resistant layer is a rubbery latex-like material.

4. Bracelet holding means as recited in claim 2 further providing that the slip resistant layer is fastened to the band means exterior at a position substantially diametrically opposed to the attachment point of the folder on the band means.

5. Bracelet holding means as recited in claim 2 further providing that the slip resistant layer is fastened to the band means interior.

6. Bracelet holding means as recited in claim 5 further providing that the slip resistant layer is fastened to the band means interior at a position substantially diametrically opposed to the attachment point of the folder on the band means.

7. Bracelet holding means as recited in claim 5 further providing that the slip resistant layer is fastened to the band means interior at a position substantially adjacent to the attachment point of the folder on the band means.

8. Bracelet holding means as recited in claim 1 further providing that the length of the first page is shorter than the length of the second page, whereby the overlapping end of the longer page provides a tab for grasping and opening the engaged faces.

* * * * *